United States Patent [19]

Moore

[11] Patent Number: 5,024,048

[45] Date of Patent: Jun. 18, 1991

[54] APPARATUS FOR DISPENSING CONTAINERS

[75] Inventor: Richard L. Moore, Fairhope, Ala.

[73] Assignee: The Lerio Corporation, Mobile, Ala.

[21] Appl. No.: 538,907

[22] Filed: Jun. 15, 1990

[51] Int. Cl.[5] ..... B65B 5/08; B65G 59/06; B65H 3/44

[52] U.S. Cl. ..... 53/534; 53/539; 53/246; 53/247; 53/249; 221/221; 221/223; 221/298

[58] Field of Search ..... 53/534, 537, 539, 244, 53/246, 247, 249; 221/298, 292, 293, 290, 289, 221, 223

[56] References Cited

U.S. PATENT DOCUMENTS

| | | | |
|---|---|---|---|
| 2,661,991 | 12/1953 | Petrecca | 221/289 X |
| 2,730,268 | 1/1956 | Moesch | 221/221 |
| 2,948,434 | 8/1960 | Wolter | 221/221 |
| 2,974,828 | 3/1961 | Matteson | 221/298 X |
| 3,120,324 | 2/1964 | Amberg et al. | 221/221 |
| 3,169,356 | 2/1965 | Dye | 53/539 |
| 3,283,952 | 11/1966 | Burt | 221/221 X |
| 3,415,416 | 12/1968 | Broersma et al. | 221/221 |
| 3,440,794 | 4/1969 | Mueller | 221/221 |
| 3,443,355 | 5/1969 | Birrell | 53/534 |
| 3,472,403 | 10/1969 | Mueller et al. | 221/221 |
| 3,601,282 | 8/1971 | Vogel | 221/298 X |
| 3,664,521 | 5/1972 | Feher | 221/221 |
| 3,795,344 | 3/1974 | Falk et al. | 221/221 |
| 3,795,346 | 3/1974 | Roberts et al. | 221/223 |
| 3,799,394 | 3/1974 | Hemard | 221/221 |
| 4,054,212 | 10/1977 | Mueller | 221/221 |
| 4,057,171 | 11/1977 | Hatori et al. | 221/298 X |
| 4,173,107 | 11/1979 | Wilson | 53/534 |
| 4,270,669 | 6/1981 | Luke | 221/221 |
| 4,271,980 | 6/1981 | Frieser et al. | 221/298 X |
| 4,312,170 | 1/1982 | Berg et al. | 53/246 X |
| 4,327,843 | 5/1982 | Corley | 221/251 |
| 4,436,222 | 3/1984 | Taylor et al. | 221/223 |
| 4,446,672 | 5/1984 | Raudat | 53/534 X |

*Primary Examiner*—Horace M. Culver
*Attorney, Agent, or Firm*—Fisher, Christen & Sabol

[57] ABSTRACT

An apparatus for dispensing individual containers, for example flower pots, from a nested stack of containers. The apparatus may be used to dispense rows of individual containers into a larger container, for example, a tray. The apparatus includes a first extendable arm for holding the stack of containers in an elevated position within a hollow column adapted to hold the stack of containers vertical, a second extendable arm for wedging the stack of containers, with the exception of the bottom container in the stack, against the side of the column and a third extendable arm for contacting the bottom container in the stack, thereby causing the bottom container to separate from the stack and fall into the tray. The apparatus also includes a wedge disposed within the column, opposite to the second extendable arm for facilitating the exposure of the lip of the bottom container. The wedge does not extend all of the way to the bottom of the column, and therefore, when the second extendable arm pushes the stack of containers laterally against the wedge, the bottom container does not contact the wedge, but rather extends towards the third extendable arm further than the other containers.

16 Claims, 3 Drawing Sheets

APPARATUS FOR DISPENSING CONTAINERS

BACKGROUND OF THE INVENTION (a) Field of the Invention

The present invention concerns a device for dispensing individual containers, for example flower pots, from a nested stack of containers. More specifically, the present invention discloses an apparatus for dispensing rows of individual containers into a larger container, for example, a tray. Individual containers are separated from the stack of containers by three synchronized extendable arms.

(b) Description of Related Art

Quick, reliable and inexpensive dispensing and alignment of individual containers (i.e., from a stack of containers) is a common necessity in many industrial processes. Millions of containers for raw or processed foods, e.g., egg cartons, cereal bowls and hamburger boxes must be dispensed and handled every business day. The apparatus of the present invention is capable of meeting these container dispensing and handling demands. The present apparatus finds particular usefulness, however, in the field of dispensing individual pots, e.g., for flowers or potted plants.

The increasing urbanization of modern life has created both many benefits and problems. Vast concentrations of workers now spend their entire working lives within large, hermetically-sealed, inner-city office buildings where space is at a premium. The tomb-like impression within many office buildings is accentuated by post-oil embargo efforts to limit climatic control expenses by minimizing airflow between the building interior and the outside world. These factors often combine to produce large bodies of stagnant dry air within buildings which have a much higher than normal concentration of carbon dioxide ($CO_2$). Such buildings often become breeding grounds for respiratory and other illnesses.

These factors have combined to greatly increase the use of interior gardens and atriums in modern office buildings, hotels and other public buildings. Interior gardens require careful management to maximize the sunlight utilization, visual appeal and oxygen ($O_2$), producing qualities of the plants during the changing seasons. Professional landscape designers and gardeners commonly rotate and vary the plants within buildings several times a year. The increased awareness of, and involvement in, managing plantings within buildings comes at the same time as more and more suburban residents are putting their environmental concerns into action by maximizing their use of plants around their homes.

These developments have given rise to increased commerce in individually-potted plants (e.g., annuals such as marigolds, cacti, etc.). Individual consumers often purchase a few such plants (e.g., typically in pots which have about a three inch on a side mouth and which are perhaps five inches deep) for their office. Consumers may also go to a nursery to select a tray (e.g., perhaps fifty-six potted plants laid out in a seven by eight array in a tray which is still small enough to be carried comfortably) of young plants for replanting in their home gardens. Once the plants have been replanted, the empty pots may often be resold to the nursery or applied as a discount against next year's purchase.

Professional gardeners are probably the biggest users of individual potted plants. In light of the tight space constrains found at many atrium and other landscaping jobs, gardeners often prefer to avoid planting large numbers of plants within the same pot since doing so would cause the plants' roots to intertwine, thereby making separation and placement of individual plants (without injuring the plants) difficult. Furthermore, gardeners° desires to be able to carry large numbers of plants from, for example, their truck to the job site at one time (e.g., through the use of seven by eight trays of individual pots) and their need to be able to reuse pots over and over have given rise to a great need for an apparatus capable of preparing trays or other groups of individual pots quickly and efficiently.

The problem of preparing, for example, a tray of tightly-spaced pots is exacerbated by the need to reuse pots after the plants they contain are replanted elsewhere (especially pots containing highly adhesive "starter" soils). Heretofore, it has often been necessary to wash each individual pot after the plant it contained has been replanted before the pot could be stacked, stored and reused. If pots were not rewashed, they often stuck together, making redistribution of the pots into an array within a tray difficult. Obviously, washing individual pots is a time-consuming, tedious, and labor-intensive task which can greatly increase a gardener's overhead expenses.

Other devices have failed to recognize this need or have tried unsuccessfully to solve the problems addressed and solved by the present invention. For example, U.S. Pat. No. 4,270,669 to Luke discloses an apparatus for separating and dispensing nursery pots which are nested in a stack. The apparatus includes a ratchet mechanism which allows the stack to move in only one direction along a predetermined path, an elongated bar mechanism for engaging the first pot at one end of the stack and pulling it away from the pots in the stack and a contact off switch which responds to the presence of a pot at a dispensing location along the path to deactivate the bar mechanism. This apparatus is clearly a suboptimization, however, since it still requires the operator to remove each pot by hand.

Other devices have been constructed which require the use of a non-vertical stack of containers. For example, U.S. Pat. No. 4,054,212 to Mueller discloses a cup dispensing apparatus and method wherein a stack of cups is moved along a generally horizontal path and individual cups are separated from the stack by a pair of gripper means which engage the rim of the cup. Also, U.S. Pat. No. 3,472,403 to Mueller et al. discloses an apparatus for handling containers wherein individual cups are pulled from the bottom of stacks of mouth-side-down containers. The device includes a plurality of studs (84) upon which individual containers are positioned which are thereafter rotated around to position the containers in a mouth-side-up orientation. These devices mandate additional handling in comparison with devices which release a container from a stack in a mouth-side-up orientation.

Other devices have been developed which include arms or other pot-moving extensions which move from side to side. For example, U.S. Pat. No. 3,415,416 to Broersma et al. discloses a pot dispenser having a cylindrical guide tube for receiving and holding a plurality of stacked pots and also having a cam actuated stripper mechanism having fingers which engage the upper edge of the lowermost pot for pushing and separating the same from the stack of pots. The dispenser further has a cam actuated clamp mechanism for holding the stack of pots in position while the lowermost pot is separated therefrom by the stripper mechanism. The fingers of the stripper mechanism are moved vertically to sequentially separate and dispense the lowermost pot from the stack. As stated in lines 30 to 34 of column six, movement by the cam means (91) causes the lever (37) to be swung outwardly from underneath the pots allowing a single pot to be dispensed and dropped into the catch plate (86).

U.S. Pat. No. 3,120,324 to Amberg et al. discloses the use of an alternative type of lateral movement. As shown in FIGS. 15–17, each stack of cups is surrounded by three cup support elements (124) and three cup stripper elements (125), these elements alternate around the periphery of the cup. Each of the cup support elements (124) and cup stripper elements (125) rotates about its own individual axis on shafts (144) and (158) respectively. As shown in FIG. 16, when a stack of cups is dropped into the dispensing apparatus, the flange on the lowermost cup comes into contact with a flange segment (180) on each of the cup support elements (124), so that the cup is supported at 120° intervals by the three cup support elements (124). At this point, the cup stripper elements (125) are not engaged with cups (34). When it is desired to dispense a cup, both the cup support and cup stripper elements are rotated so that they reach the position shown in FIG. 17, in which the second cup from the bottom of the stack is supported by flanges (179) on the cup support elements (124), while the flange of the lowermost cup in the stack is no longer supported by the flange elements (180). Simultaneously, the flange of the lowermost cup is gripped by a groove (177) in the cup stripper elements (125). This groove varies in height around the periphery of the cup stripper elements (125), and as these elements continue to rotate, the lowermost cup is pulled downwardly to the position shown in FIG. 15, at which point the lowermost cup drops from the stack assisted by a flange (118) on the cup stripper element. Further rotation of the elements (124) and (125) returns the apparatus of the position shown in FIG. 16.

Since these types of devices require significant open space around the edge of each container (in order to accommodate the positioning/movement of the container-handling machinery) they often cannot be used in situations where multiple rows of containers must be dispensed in tight formation.

Other devices require the utilization of complicated mechanisms involving multiple cams, springs, rollers and extending finger-like members. For example, U.S. Pat. No. 4,327,843 to Corley discloses a cup dispensing mechanism having a pair of coacting jaws which each contact nearly one-half of the periphery of the cup. Each jaw has sufficient flexibility to fully conform to the cup contour thereby making it possible to grasp cups having varying dimensions. After the cup is grasped, the jaws are moved axially with respect to the cup to withdraw the cup from the stack. The jaws then open to release the cup and return to their initial position to be ready to grasp the next cup. A plurality of resiliently-biased fingers placed about the bottom of the hopper hold the stack of cups; however, when a cup is drawn away, they retract sufficiently to release that cup but grasp the next cup. Devices of this complexity may obviously be prone to break down.

Other devices, even devices which house/dispense multiple stacks of containers, utilize multiple sets of prying members which slide between, and pull apart the rims of the bottom two containers. For example, U.S. Pat. No. 3,795,344 to Falk et al. discloses a bowl or cup dispenser capable of dispensing two sets of cups. As shown in FIG. 4, the device utilizes two opposed sets of fingers (113) which slide under the lip of the next-to-bottom cup and above the bottom cup. The fingers progressively widen along their length with the result that the bottom cup is eventually pried from the stack. The lateral movement of these fingers makes positioning multiple columns of cups in close proximity to each other (i.e., capable of dispensing multiple pot arrays into a tray) impossible.

Other devices focus on the rim of the bottom container. For example, U.S. Pat. No. 4,436,222 to Taylor et al. discloses a variety of rim-grabbing mechanisms (e.g., round notches—FIG. 2 and square notches—FIG. 3) which often need to encircle a substantial portion of the container to be effective (see, e.g., FIGS. 5 and 6). The effectiveness of these types of devices is severely hampered if the container's rim is damaged, non-uniform or partially covered with debris.

Therefore, a quick, reliable and simple device for separating individual flower pots from a stack of pots and depositing the pots into a multi-pot array without the necessity of handling by workers has not heretofore been available.

SUMMARY OF THE INVENTION

The present apparatus for dispensing individual containers, for example flower pots, from a stack of nested containers solves the above-noted problems. The apparatus may dispense rows of individual containers into, for example, a tray. In this way, arrays of individual pots (e.g., a seven by eight tray) may quickly be assembled to contain a plurality of plants.

The apparatus includes a first extendable arm for holding a stack of containers in an elevated position within a hollow column adapted to hold the stack of containers substantially vertical. A second extendable arm is used to wedge the stack of containers, with the exception of the bottom container in the stack, against the side of the column. Finally, a third extendable arm is used to contact the lip of the bottom container in the stack, thereby causing the bottom container to separate from the stack and fall into a tray.

The apparatus also includes a wedge disposed within each column, opposite to the second extendable arm, for facilitating the exposure of the lip of the bottom container. The wedge does not extend all of the way to the bottom of the column with the result that when the second extendable arm pushes the stack of containers laterally against the wedge, the bottom container does not contact the wedge, but rather extends towards the third extendable arm further than the other containers. This differential in the position of the bottom container in the stack relative to the other containers facilitates the contacting of the third extendable arm against the lip of the bottom container, and hence, maximizes the container-separating effectiveness of the present apparatus.

The columns (and hence, the first, second and third extendable arms) of the present invention may be configured in very close proximity to each other. This in turn allows the apparatus to deposit rows of tightly-spaced individual containers into, for example, a tray positioned beneath the bottom of the columns. Trays may conveniently be carried on conveyor belts beneath the columns to further optimize the labor-saving potential of the present invention.

In this way, the prying action exerted upon the bottom container by the first, second and third extendable arms, (which is facilitated and augmented by the wedge mounted inside of the column) is able to separate the bottom container from a stack of containers even when the containers are adhered together with dried soil and plant debris.

Figure 2:
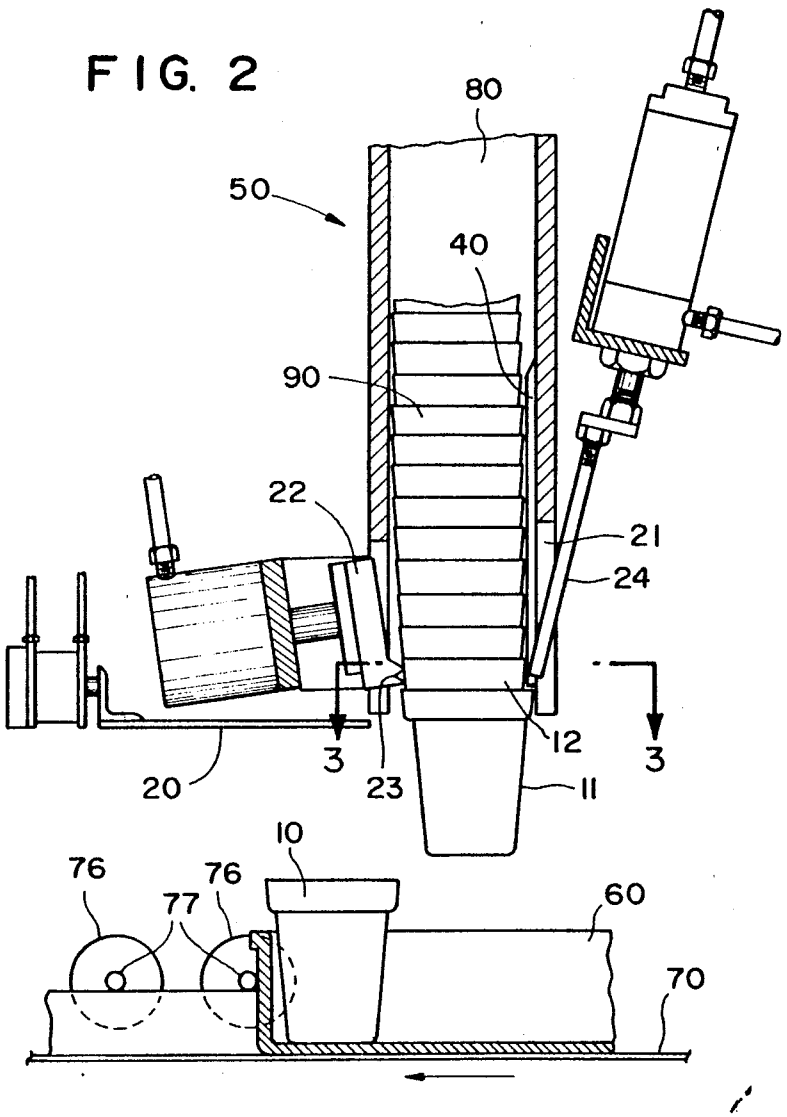
FIG. 2 is a side view, partially in section, showing an individual container dispensing apparatus of the present invention with the second extendable arm extended and the first extendable arm retracted.

DETAILED DESCRIPTION OF THE PREFERRED EMBODIMENT (a) Apparatus

While the invention is susceptible of embodiment in many different forms, there is shown in the drawings (wherein like numbers refer to like elements throughout) and will hereinafter be described in detail, a preferred embodiment of the invention with the understanding that the present disclosure is to be considered as an exemplification of the principles of the invention and is not intended to limit the invention to the embodiment illustrated.

Figure 4:
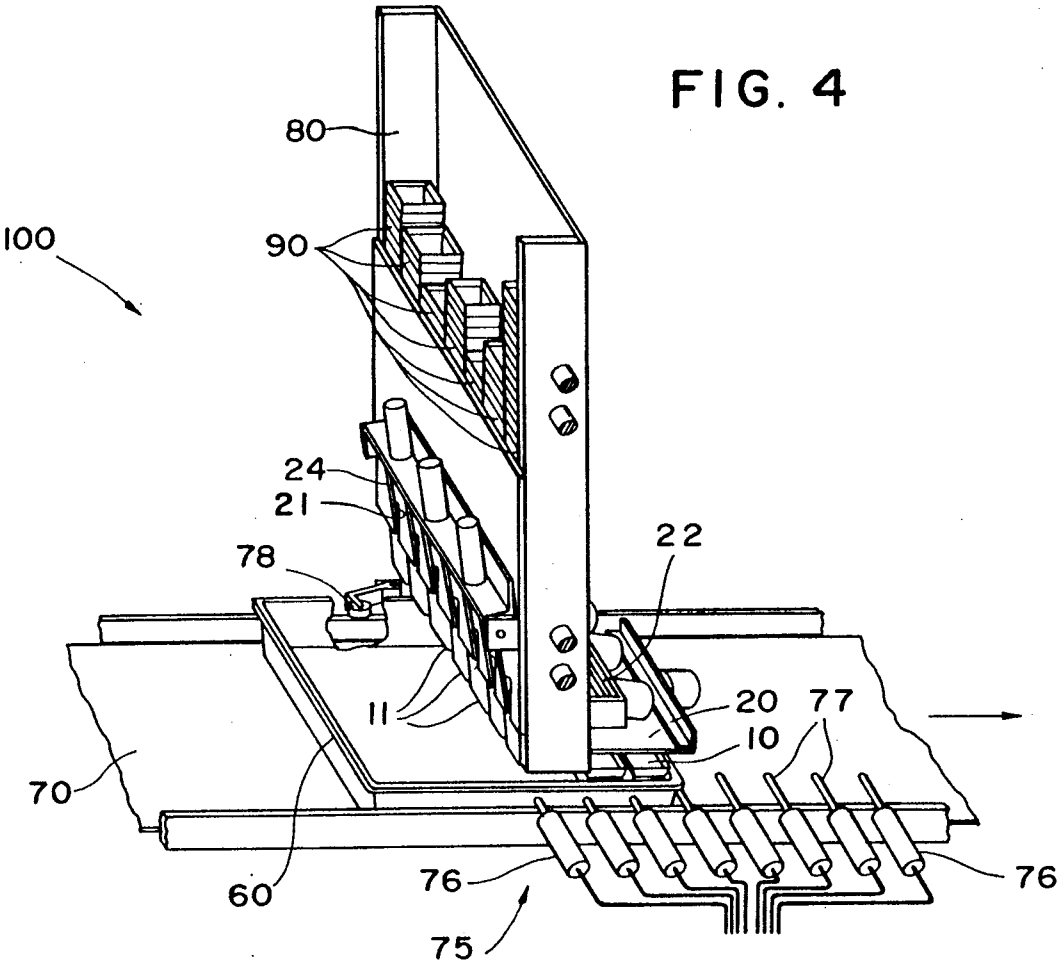
FIG. 4 is a perspective view of an embodiment of the inventive apparatus capable of dispensing rows of seven pots into trays together with a conveying mechanism for handling the trays of pots.

As shown in FIG. 4 (FIG. 4), the present apparatus for dispensing containers, may be configured to dispense individual containers from a plurality of stacks 90. The embodiment of the apparatus 100 shown in FIG. 4 may be used to dispense a row of seven individual containers. Clearly, however, embodiments of the present invention capable of handling different numbers of stacks of containers may also be formulated.

Each stack of containers 90 is disposed within a hollow column 80 which is essentially vertical. The columns 80 may diverge from vertical to some degree, but a vertical alignment is preferred since this helps to optimize the stability of the stack of containers 90, especially when the stack of containers 90 extends above the top of the column 80.

The apparatus 100 preferably also includes a conveyor belt 70 or other means for conveying larger containers, e.g., trays 60, beneath the columns 80 whereby rows of containers 10 may be deposited into the tray 60 in tight formation. Conveyor belts 70 have proved capable of fulfilling this objective admirably, but clearly many other conveying means could also be utilized. The conveyor belt 70 may be used alone, i.e., in which case workers would place empty trays 60 on the belt 70 upstream from the stacks of containers 90 and later remove trays 60 filed with individual containers 10 downstream from the stacks of containers 90. Alternatively, however, additional conveyor belts or other tray moving mechanisms may be operatively connected with either the start or finish of the conveyor belt 70 passing beneath the stacks of containers 90 to further decrease the amount of manual labor required during the flower pot loading process.

As shown in FIG. 4, the conveyor belt 70 is preferably operatively connected with an appropriate indexing means 75 to control the movement of the trays 60 along the conveyor belt 70. For example, the indexing means 75 may preferably comprise a plurality of index cylinders 76, each having an extendable prong 77, aligned along at least one side of the conveyor belt 70. The indexing means 75 may also be disposed along both sides of the conveyor belt 70, but preferably the index cylinders 76 are only disposed along one side of the conveyor belt 70. This configuration advantageously allows an inwardly-based (e.g., air pressure-operated, spring-loaded) squaring device 78 to be disposed on the side of the conveyor belt 70 opposite to the index cylinders 76. The squaring device 78 helps to assure the precise positioning of the tray 60 (and hence, the accurate deposition of the individual containers 10) and allows the apparatus to accommodate trays 60 of slightly varying sizes.

At the start of the container-loading cycle, the extendable prongs 77 of the index cylinders 76 are extended outward, orthogonal to the axis of movement of the conveyor belt 70. As a tray 60 moves along the length of the conveyor belt 70, it eventually comes in contact with the first of the extendable prongs 77 causing the tray 60 to stop moving while the conveyor belt 70 continues to move (i.e., sliding underneath the tray 60). At that point, the tray is in position to receive the first row of containers 10. The frictional force exerted by the moving conveyor belt 70 upon the immobilized tray 60 holds the tray 60 securely against the extendable prong 77, thereby maintaining correct positioning of the tray 60 throughout the dispense cycle. Clearly many types of indexing means 75 may be utilized, but index cylinders 76 having extendable prongs 77 have proven quite advantageous.

As will be discussed more fully hereinafter, once the first row of containers 10 has been deposited within the tray 60, the first extendable prong 77 is retracted and the conveyor belt 70 moves the tray 60 forward until the tray contacts the second extendable prong 77 within the group of extendable prongs, causing the tray 60 to stop moving. Thereafter, a second row of containers 10 is deposited into the tray 60.

The process is continued until the entire tray is filled with individual containers (e.g., in a seven by eight array), by which point all of the extendable prongs 77 have been retracted (e.g., in FIG. 4—eight extendable prongs for eight rows of containers are shown). Thereafter, the tray 60 will continue down the conveyor belt 70, the extendable prongs 77 of the index cylinders 76 will reset to their original position (i.e, orthogonally extended relative to the direction of motion of the conveyor belt 70) and the apparatus 100 will be ready to begin the container-loading process again with the next tray 60.

Figure 1:
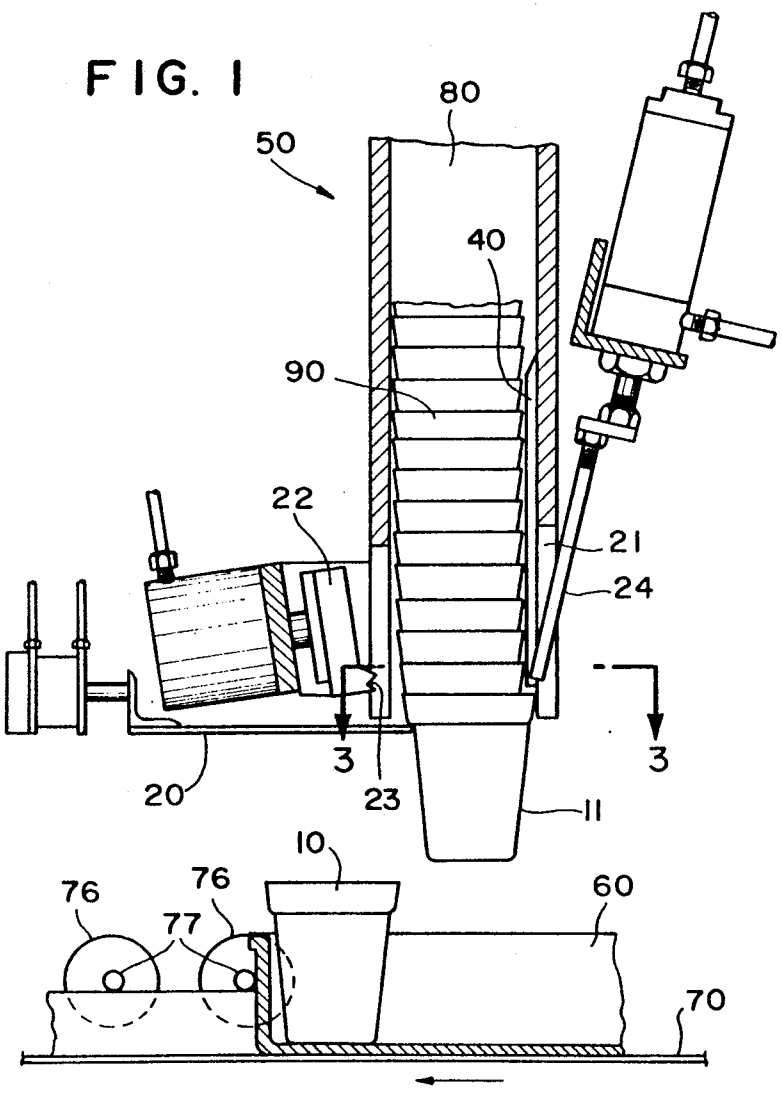
FIG. 1 is a side view, partially in section, showing an individual container dispensing apparatus of the present invention with the first extendable arm extended.

Turning to the container separating and dispensing portion 50 of the apparatus, as shown in FIG. 1 (FIG. 1), this portion of the apparatus 100 includes a hollow column 80 for holding a stack of containers 90. As discussed above, the apparatus for dispensing containers of the present invention 100 may process a large number of stacks of containers 90 simultaneously (e.g., FIG. 4 shows an embodiment of the apparatus equipped to process seven stacks of containers simultaneously), but for simplicity, only one such stack 90 (and one container separating and dispensing portion 50 of the apparatus) will be considered at this time.

Each container separating and dispensing portion 50 of the apparatus includes a column 80 for holding a stack of containers 90. As shown in FIG. 1, the column 80 is preferably somewhat wider than the stack of containers 90, but not overly so. In this way, the stack of containers will be held in a reasonably stable fashion, but the width of the column 80 will still be large enough to allow for easy loading and quick replenishment of the stack of containers 90.

The shape of the column 80 should approximately reflect the shape of the containers being dispensed by the apparatus 100 (e.g., round column for round containers—square column for square containers, etc.). The configuration of the column 80 should also include enough free space to allow for handling of containers of varying dimensions. The apparatus 100 preferably also includes a series of thin column dividers 81 disposed between the columns 80 to help keep the stacks of containers 90 separated. The columns 80 may be constructed for use with many different sizes and numbers of containers, and with enough free space to handle containers of slightly varying dimensions.

The stack of containers 90 is immobilized within the column 80 by a first extendable arm 20. The first extendable arm 20 is positioned at the bottom of the column 80. In order to immobilize the stack of containers 90 the first extendable arm 20 extends outwardly into the mouth of the column 80 whereby, as shown in FIG. 1, the containers are wedged within the column 80. The first extendable arm 20 may advantageously be calibrated to catch the lowermost container under the lip (as shown in FIG. 1). Alternatively, especially since flower pots and other nested containers normally have outwardly sloping walls (viewing the container from the bottom to the top), the first extendable arm 20 can also be used to immobilize the stack of cups 90 by contacting a point along the wall of the container below the lip of the container.

Figure 5:
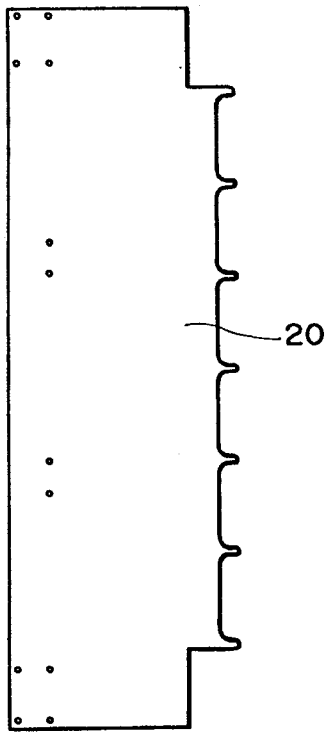
FIG. 5 is a top plan view of an alternate embodiment of the first extendable arm of the present invention specially configured for use with square pots, i.e., to extend under the lip of the pot.

As shown in FIG. 5 (FIG. 5), the first extendable arm 20 can also be specially configured for optimal utilization with the particular type of containers being handled by the apparatus. For example, the embodiment of the first extendable arm 20 shown in FIG. 5 is configured for use with square pots, whereby the first extendable arm 20 preferably extends laterally until it contacts the bottom container 11 under the lip.

Each container separating and dispersing portion 50 of the apparatus 100 also includes a second extendable arm 22 which is positioned above the first extendable arm 20. The second extendable arm 22 is positioned such that, when the stack of containers 90 is immobilized by the first extendable arm 20 and thereafter the second extendable arm 22 is extended, the second extendable arm 22 will contact the second-from-bottom (or penultimate) container 12.

Figure 3:
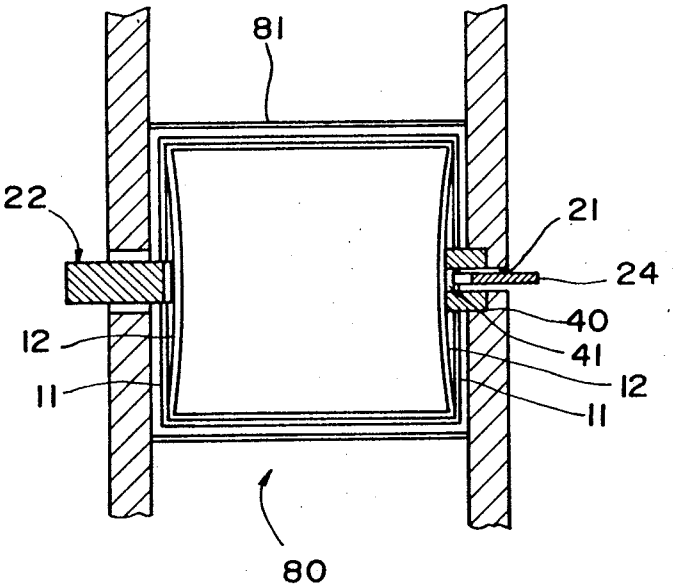
FIG. 3 is a top view, in section, along line 3—3 of FIG. 2.

The front of the second extendable arm 22 (i.e., which contacts the second-from-bottom container 12) preferably includes a notch 23 to facilitate firm gripping of the second-from-bottom container 12. The notch 23 may be beneficially employed since one prong of the notch 23 may grip under the lip of the container (e.g., as shown in FIG. 3 of U.S. Pat. No. 4,436,222 to Taylor et al.). Also, the notch 23 helps to prevent fouling of the second extendable arm 22 by debris adhered to the outer lip of the containers 10 (which could lead to excess force being exerted upon the containers by the second extendable arm 22). Finally, when especially smooth and/or slippery pots are being handled, the notch 23 disposed at the end of the second extendable arm 22 can be configured to include sharp points which can actually dig into the outside of the penultimate container 12, thereby further avoiding slippage of the pot 12.

Preferably the first 20 and second 22 extendable arms are disposed one above the other. This arrangement limits the space required to configure the apparatus 100, which in turn allows rows of containers to be dispensed very close together. More preferably, the first 20 and second 22 extendable arms are positioned so that they extend and retract along a line parallel to the direction of movement of the conveyor belt 70 (i.e., orthogonal to the row of containers 10 deposited by the apparatus) this positioning helps to further limit the space requirements of the apparatus 100.

The container separating and dispensing portion 50 of the apparatus also includes a wedge 40 positioned lengthwise within the interior of the column 80 parallel to the length of the stack of containers 90. As shown in FIG. 2 (FIG. 2), the wedge 40 is preferably disposed on the side of the column 80 opposite to the first 20 and second 22 extendable arms. As will be discussed more fully hereinafter in the course of explaining the operation of the apparatus, this configuration helps to maximize the wedging action exerted upon the bottom container 11 in the stack of containers 90 by the apparatus. This configuration also helps to minimize the space requirements of the apparatus which in turn makes it possible to dispense tightly-spaced rows of containers.

The wedge 40 preferably does not extend to the top of the column 80 in order that the top opening of the column 80 not be restricted. This helps to facilitate the quick and easy loading of containers into the top of the column 80 (i.e., the replenishment of the stack of containers 90). The wedge 40 also does not extend to the bottom of the column 80. As shown in FIG. 2, the wedge 40 does not extend below the second-from-bottom container 12. Therefore, when the second extendable arm 22 extends (in FIG. 2, shown as pushing the stack of containers 90 to the right and eventually wedging the containers against the wedge 40 and perhaps to a limited degree, the side of the column 80), the bottom container 11 does not come in contact with the wedge 40.

In this way, the points of contact between the second-from-bottom container 12 and the bottom container 11 serve as an axis for the scissoring action brought to bear upon the two containers by the wedging action of the different elements of the apparatus (i.e., the first extendable arm 20 and the second extendable arm 22/wedge 40). This scissoring action alone is often sufficient to separate the bottom container 11 from the stack 90.

To provide for situations wherein this scissoring action is not sufficient to separate the bottom two containers, however, the container separating and dispensing portion 50 of the apparatus also includes a third extendable arm 24. As shown in FIG. 1, FIG. 3 (FIG. 3) and FIG. 6 (FIG. 6) the third extendable arm 24 is preferably disposed in close proximity to the wedge 40. The third extendable arm 24 is preferably positioned at an acute angle relative to the stack of containers 90 (i.e., close to, but not completely perpendicular to the direction of movement of the first extendable arm 20 and to the direction of movement of the conveyor belt 70).

Figure 6:
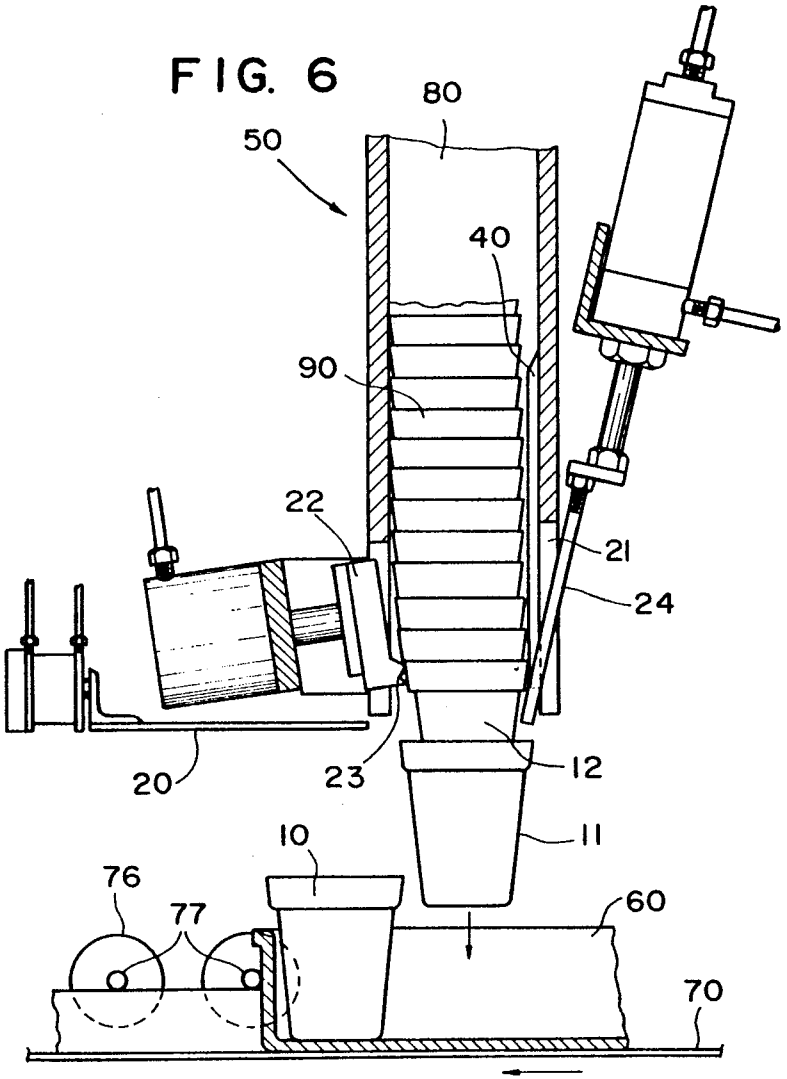
FIG. 6 is a side view, partially in section, showing an individual container dispensing apparatus of the present invention with the third extendable arm extended.

The third extendable arm 24 preferably gains access to the lip of the bottom container 11 through a slot 21 in the wall of the column 80. As shown in FIG. 3, the third extendable arm 24 extends downwardly and preferably, contacts the lip of the bottom container 11 in the stack (more preferably the upper surface of the lip) thereby prying the bottom container 11 from the stack (as shown in FIG. 6). As shown in FIG. 3, the wedging action exerted upon the bottom 11 and second-from-bottom 12 containers by the relative movement of the second extendable arm 22 and the wedge 40 forces the lip of the bottom container 11 away from the rest of the stack of containers 90 whereby it may more easily be contacted by the third extendable arm 24. This wedging action also helps to free the containers from any adhesion caused by dried soil or plant material trapped between the containers.

In an alternate embodiment, the third extendable arm 24 may be positioned to contact the bottom container lower down. For example, some types of pots have drainage openings disposed at the bottom of the sides of the pot. When it is desired to dispense these types of pots with the apparatus, the third extendable arm 24 is preferably positioned to contact the bottom of the pot through the openings in the sides of the pot, and to thereby pry the bottom container 11 away from the rest of the stack of containers.

As shown in FIG. 3, most preferably, the wedge 40 includes a central slot 41 incised into the wedge 40 near the bottom end thereof. This slot 41 in the wedge 40 allows the third extendable arm 24 to be positioned directly behind the wedge 40 and to gain access to the bottom container 11 directly through the wedge 40 (as shown in FIG. 3).

As shown in FIGS. 1, 2, 4 and 6 the container separating and dispensing portion 50 of the apparatus is preferably positioned fairly near (i.e., not too far above) the tray 60. In this way, once the bottom container 11 is freed from the stack of containers 90 (i.e., by the retraction of the first extendable arm 20 and, if necessary, by coming in contact with the third extendable arm 24) the container 11 will drop down a short distance and fit itself into alignment with the other containers within a row of containers deposited within, for example, a tray 60.

The first 20, second 22 and third 24 extendable arms may be extended and retracted by any suitable means. In FIGS. 1, 2 and 6 air cylinders are shown being utilized for this purpose, but clearly hydraulic cylinders or any other suitable mechanical or electrical mechanism may also be utilized to extend and retract the first 20, second 22 and third 24 extendable arms (as well as the extendable prongs 77 of the indexing cylinders 76).

(b) Operation

Before the process of dispensing individual containers 10 may begin, the first extendable arm 20 is extended, the second extendable arm 22 is retracted and the third extendable arm 24 is retracted. Thereafter, containers are loaded (bottom side down/mouth side up) into the columns 80. The first extendable arm 20 (which is extended) immobilizes the bottom container 11 (and hence the entire stack of containers 90) by catching the container under the lip (as shown in FIG. 1) or elsewhere along the upper side portion of the container.

The individual containers are intended to be loaded into a tray 60 or other suitable container once the container has been brought into position under the columns 80. The tray 60 can be positioned by hand if necessary, but preferably the tray 60 is brought into position by appropriate mechanical means (e.g., by a conveyor belt 70). As outlined above, suitable indexing means 75 (e.g., a series of index cylinders 76, each having an extendable prong 77, most preferably used in conjunction with a squaring device 78 disposed on the opposite side of the conveyor belt 70 relative to the indexing means 75—as shown in FIG. 4) are employed to initiate and coordinate the movement of the tray 60 relative to the container-separating and dispensing action of the apparatus. Therefore, this aspect of the operation of the apparatus will not be repeated at this time.

Once the tray 60 is in position to receive a row of containers 10, the dispensing cycle may being. As shown in FIG. 2, in the first step of the dispensing cycle, the second extendable arm 22 is extended. This pushes the stack of containers 90 to the right and, with the exception of the bottom container 11, wedges the containers against the wedge 40 disposed within the column 80. As shown in FIGS. 2 and 3, since the bottom container 11 is not pinned against the wedge 40 (by the second extendable arm 22) along with the other containers in the stack 90, the lip of the bottom container 11 is extended outwardly away from the second extendable arm 22 (relative to the stack of containers 90) by this step of the process.

In the second step of the dispensing cycle, as shown in FIG. 2, the first extendable arm 20 is retracted. It is expected that, with new or completely washed containers, the retraction of the first extendable arm 20, combined with the scissoring action created by the relative stresses (exerted upon the bottom 11 and second-from-bottom 12 containers) created by the second extendable arm 22 and wedge 40 will cause the bottom container 11 to drop from the stack 90 (e.g., into the tray 60). In situations where the containers are adhered together with dried soil or plant material, or when small dents in the bottom container 11 (e.g., a thin-gauge plastic flower pot) wedge the bottom container 11 against the penultimate container 12, however, additional force is needed to separate the containers.

Therefore, in the third stage of the dispensing process, as shown in FIG. 6, the third extendable arm 24 extends downwardly through the slot 21 in the wall of the column 80 (and more preferably, through the slot 41 incised in the wedge 40 as well) and preferably contacts the lip of bottom container 11 (as shown in FIG. 3—as outlined above, in an alternate embodiment, the third extendable arm 24 is positioned to extend downwardly through an opening disposed in the lower side of the container and thereby to contact the bottom of the container). The impact of the third extendable arm 24 against the bottom container 11 serves to strip the bottom container 11 from the stack of containers 90, whereupon the bottom container 11 falls into the tray 60.

In the fourth stage of the dispersing process, the third extendable arm 24 retracts and the first extendable arm 20 is extended. Thereafter, the second extendable arm 22 is retracted causing the stack of containers 90 to drop until the bottom container 11 (and hence the entire stack of containers 90) is immobilized by first extendable arm 20. At that point, the container which had previously been the second-from-bottom container 12 is now the bottom container 11 and the container separating and dispensing portion 50 of the apparatus is ready to begin another dispensing cycle (as soon as the indexing means 75 and conveyor belt 70 have advanced the tray 60 forward an appropriate distance for receiving the next row of containers).

Especially when conveyor belts 70 or other means for moving trays 60 of containers are utilized, extremely little manual labor is required to utilize the present apparatus. Primarily, the operator need only assure that sufficiently large stacks of containers 90 are maintained within each column 80. In this regard, the near vertical orientation of the columns 80 assists the operator by allowing him or her to put large stacks of containers into the columns 80 at a time.

As noted above, the apparatus for dispensing containers of the present invention may be used to dispense a wide variety of differently sized and shaped containers. Nevertheless, the apparatus is particularly useful in dispensing individual flower pots into, for example, a tray.

As many different embodiments of this invention will now have occurred to those skilled in the art, it is to be understood that the specific embodiments of the invention as presented herein are intended by way of illustration only and are not limiting on the invention, but that the limitations thereon can be determined only from the appended claims.

What is claimed is:

1. An apparatus for separating and dispensing individual containers from a stack of containers comprising:

at least one hollow column having an open upper and lower mouth for holding a stack of containers substantially vertical, each of said hollow columns being operatively associated with:

(a) a first extendable arm operatively associated with said hollow column whereby when said first extendable arm is extended into the lower mouth of said hollow column, said stack of containers will be prevented from falling out of said column;

(b) a second extendable arm operatively associated with said hollow column whereby after said first extendable arm is extended and thereafter said second extendable arm is extended, said second extendable arm will contact the penultimate container in the stack of containers and press said container against the side of said hollow column opposite to said second extendable arm;

(c) a wedge affixed to the inside of said hollow column on the side of said column opposite to said second extendable arm, the length of said wedge and the length of said column being substantially parallel, said wedge terminating above the bottom container in said stack of containers whereby when said second extendable arm is extended and said stack of containers is pressed against said wedge, the bottom container in the stack of containers will not be pressed against the wedge and the lip of the bottom container will extend in the direction opposite said second extendable arm further than the lips of the other containers in said stack of containers; and (d) a third extendable arm operatively associated with said hollow column whereby said third extendable arm may extend to contact said bottom container in said stack of containers, whereby said bottom container is separated from said stack of containers.

2. The apparatus for separating and dispensing individual containers of claim 1 further comprising conveying means for moving an enlarged container beneath said stack of containers, whereby individual containers may be deposited into said enlarged container by said apparatus.

3. The apparatus for separating and dispensing individual containers of claim 2 further comprising indexing means for controlling the movement of said enlarged container whereby when said enlarged container reaches a predetermined point along said conveying means, said enlarged container will stop moving and the bottom container in said stack of containers will be deposited into said enlarged container, and thereafter, said indexing means will reactivate the movement of said enlarged container whereby a plurality of individual containers may be sequentially dispensed into said enlarged container in tight formation.

4. The apparatus for separating and dispensing individual containers of claim 3 wherein said indexing means comprises a series of index cylinders disposed along one side of said conveying means, each of said indexing cylinders further including an extendable prong.

5. The apparatus for separating and dispensing individual containers of claim 4 further comprising means for squaring the positioning of said enlarged container relative to said apparatus, said squaring means being disposed on the side of said conveying means opposite to said indexing means.

6. The apparatus for separating and dispensing individual containers of claim 1 wherein said apparatus can separate and distribute individual containers from seven columns of containers substantially simultaneously.

7. The apparatus for separating and dispensing individual containers of claim 1 wherein said second extendable arm is disposed directly above said first extendable arm.

8. The apparatus for separating and dispensing individual containers of claim 7 wherein said third extendable arm is disposed on substantially the opposite side of said stack of containers relative to said first extendable arm and said second extendable arm.

9. The apparatus for separating and dispensing individual containers of claim 8 wherein said wedge includes a slot, whereby said third extendable arm may extend through said slot in said wedge to contact said bottom container.

10. The apparatus for separating and dispensing individual containers of claim 1 wherein the front edge of said second extendable arm is notched.

11. The apparatus for separating and dispensing individual containers of claim 1 wherein said first, second and third extendable arms are extended and retracted by pneumatic means.

12. The apparatus for separating and dispensing individual containers of claim 1 wherein said first, second and third extendable arms are extended and retracted by hydraulic means.

13. The apparatus for separating and dispensing individual containers of claim 1 wherein said third extendable arm contacts the lip of said bottom container.

14. The apparatus for separating and dispensing individual containers of claim 1 wherein said third extendable arm contacts the bottom of said bottom container.

15. An apparatus for separating and dispensing individual containers from a stack of containers comprising:

(a) a hollow column for holding said stack of containers substantially vertical, said column having an open upper and lower mouth;

(b) a first extendable arm operatively associated with said hollow column whereby when said first extendable arm is extended into the lower mouth of said hollow column, said stack of containers will be prevented from falling out of said column;

(c) a second extendable arm operatively associated with said hollow column whereby after said first extendable arm is extended and thereafter said second extendable arm is extended, said second extendable arm will contact the penultimate container in the stack of containers and press said container against the side of said hollow column opposite to said second extendable arm;

(d) a wedge affixed to the inside of said hollow column on the side of said column opposite to said second extendable arm, the length of said wedge and the length of said column being substantially parallel, said wedge terminating above the top of the bottom container in said stack of containers whereby when said second extendable arm is extended and said stack of containers is pressed against said wedge, the bottom container in the stack of containers will not be pressed against the wedge and the lip of the bottom container will extend in the direction opposite said second extendable arm further than the other containers in said stack of containers; and (e) a third extendable arm operatively associated with said hollow column whereby said third extendable arm may extend to contact said bottom container in said stack of containers, whereby said bottom container is separated from said stack of containers.

16. A device for separating and dispensing a plurality of individual containers from a plurality of columns of containers, said device comprising a plurality of the apparatuses of claim 11.

* * * * *